United States Patent [19]

Zen

[11] Patent Number: 4,968,005

[45] Date of Patent: Nov. 6, 1990

[54] PICKET ATTACHMENT

[76] Inventor: Giuseppe Zen, 7465 Conway Avenue, Burnaby, B.C., Canada, V5E 2P7

[21] Appl. No.: 415,933

[22] Filed: Oct. 2, 1989

[51] Int. Cl.[5] ..... E04H 17/14

[52] U.S. Cl. ..... 256/22; 256/65

[58] Field of Search ..... 256/22, 21, 65, 59

[56] References Cited

U.S. PATENT DOCUMENTS

| | | | |
|---|---|---|---|
| 3,924,834 | 12/1975 | Young | 256/59 X |
| 3,975,000 | 8/1976 | Sado | 256/59 |
| 4,014,520 | 3/1977 | Walters | 256/22 |
| 4,334,671 | 6/1982 | DeGuise | 256/22 X |
| 4,346,872 | 8/1982 | Tornya | 256/65 |
| 4,805,879 | 2/1989 | Spera | 256/22 X |

*Primary Examiner*—Peter M. Cuomo

*Attorney, Agent, or Firm*—Townsend and Townsend

[57] ABSTRACT

A structure, useful as a balustrade or fence, comprising a rail attached to a plurality of pickets. The rail has first and second longitudinal members that are pressed together to form the rail. There are spaced openings formed in one longitudinal member with an open edge for each opening at an edge of the longitudinal member. Channels are formed in each side of the picket member, adjacent an end of the picket member. There are projections on the first and second members, adjacent to each opening. Each projection is received in a channel of a picket. The arrangement of channels and projections provides a rattle-free structure. The structure can be further improved by the incorporation of a settable compound to assist in the pressing together of the first and second members.

6 Claims, 2 Drawing Sheets

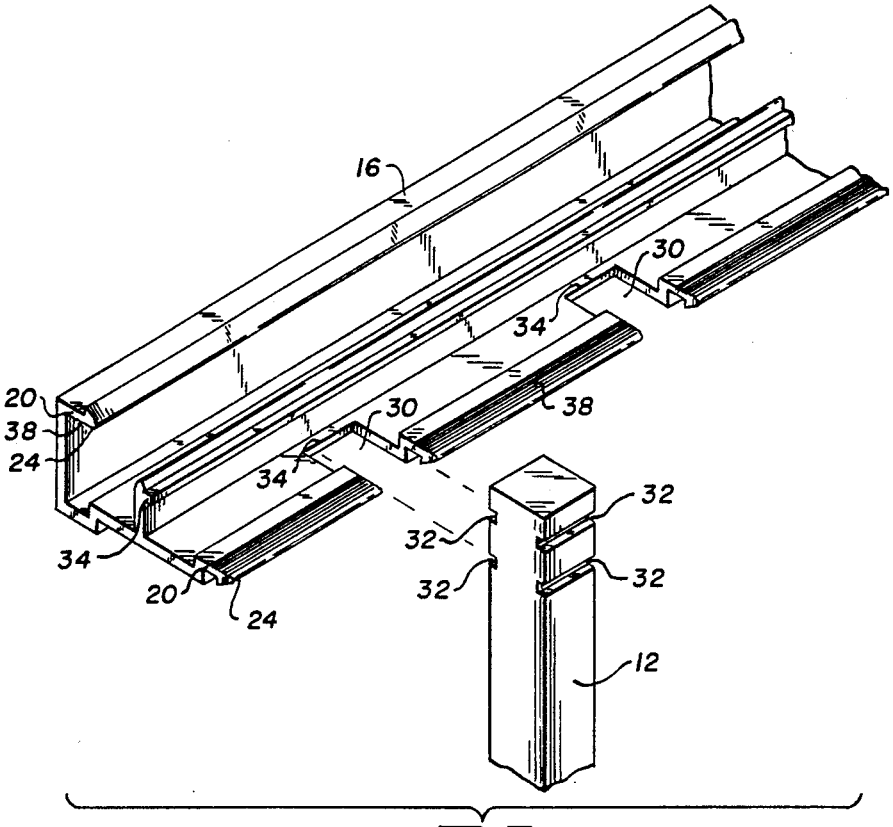
Fig. 3.
Fig. 4.
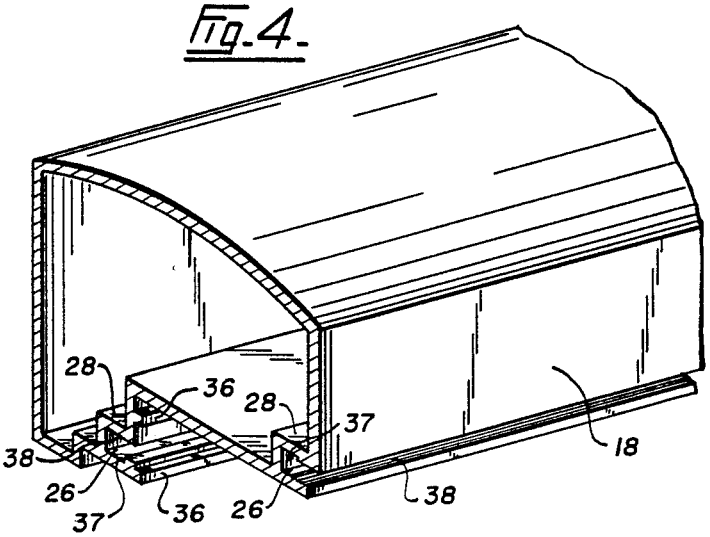

PICKET ATTACHMENT

FIELD OF THE INVENTION

This invention relates to a structure, particularly a structure useful to form fencing, balustrades and the like.

DESCRIPTION OF THE PRIOR ART

Fencing and balustrades, for example on patios and balconies, are well known. They provide a pleasing appearance. They may be of wrought iron, wood or, increasingly, aluminum. Aluminum has the great virtues of excellent weather resistance, ease of formation, lightness and is itself of pleasing appearance. In certain circumstances, aluminum is not coated at all but, in other circumstances, a simple clear lacquer finish is sufficient to provide a maintenance free surface.

The fencing or balustrade typically comprises a top rail secured to pickets, that is vertical members extending downwardly from the top rail and spaced at any desired intervals. The pickets may extend into a wooden or concrete base or the like or, more usually, are also attached to a bottom rail. The rails are supported on end posts which are mounted to a base structure; the steps, balcony or the like for which the structure provides an edge.

In aluminum structures, the pickets may be attached to the rails in a variety of ways. My U.S. Pat. No. 4,125,249 issued 14 Nov., 1978 shows a system in which variation of the angle of a picket to the rail is achieved. However, in many structures a permanent attachment is used. For example, the pickets may be welded to longitudinal rails. A further known system is the use of a snap-together rail comprising longitudinal sections that can be joined together by snap-fit. There are openings formed in one of the longitudinal members to receive the pickets. A disadvantage of the system is that the pickets are a loose fit within the rail structures, which is undesirable. Longitudinal members of this type are used for both top and bottom rails.

The present invention seeks to provide a simple solution to the above problem of loose pickets and, in addition, provides an improvement for securing the longitudinal members that form the rail.

SUMMARY OF THE INVENTION

Accordingly, the present invention, in a first aspect, is a structure having a rail attached to a plurality of pickets, the rail comprising first and second longitudinal members that are pressed together to form the rail, the improvement comprising a plurality of spaced openings formed in the first longitudinal member with an open edge for each opening at an edge of the first longitudinal member; a plurality of channels formed in each side of each picket adjacent and end of the picket; a plurality of spaced projections on the first and second longitudinal members, adjacent each opening to be received in the channels of said pickets to locate the pickets.

In a preferred embodiment there are a pair of male members formed at the inner edge of the first longitudinal members and a pair of female members formed at an inner edge of the second longitudinal member to receive the male members with a press fit to form the rail. In a particularly preferred aspect a settable compound, for example an epoxy adhesive or a silicone compound, is put in the female members to secure the male members. This, together with the location of the pickets by the use of the above arrangement of projections and channels, provides a particularly stable structure.

BRIEF DESCRIPTION OF THE DRAWINGS

Aspects of the invention are illustrated, merely by way of example, in the accompanying drawings, in which:

FIG. 3 is a partial exploded view of the structure of FIG. 1; and

FIG. 4 is a further detail of the structure of FIG. 1.

DESCRIPTION OF THE PREFERRED EMBODIMENTS

Figure 1:
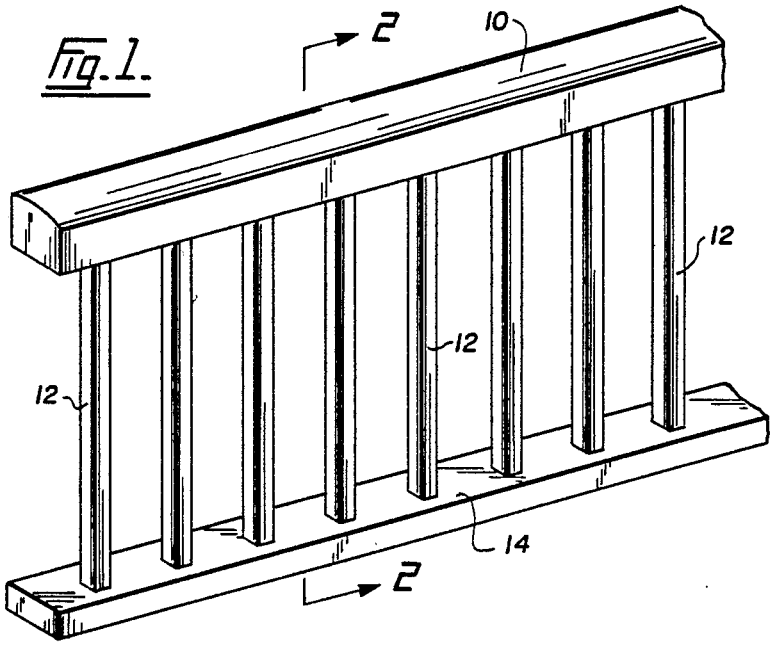
FIG. 1 is a detail of a structure according to the present invention.

The drawings show a structure having a top rail 10 attached to a plurality of pickets 12. In the embodiment of FIG. 1, a bottom rail 14 is also shown but the bottom rail is not essential. The pickets 12 may simply extend to the ground, into concrete or into an underlying wooden structure.

Figure 2:
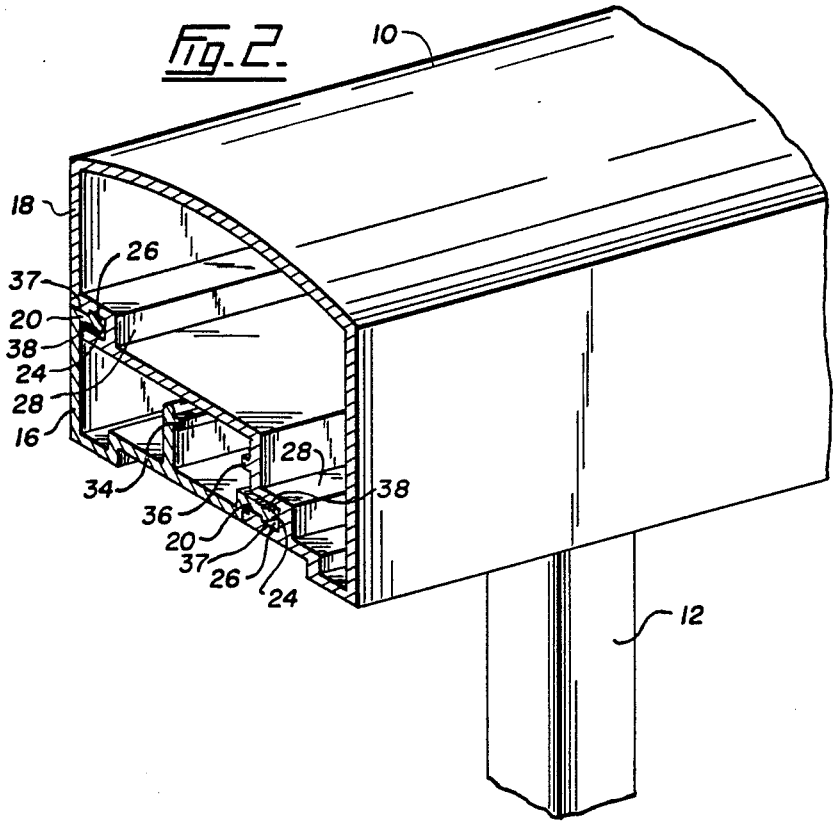
FIG. 2 is a detail on the line FIG. 1.

Rail 10 comprises first and second longitudinal members 16 and 18 that, as shown most clearly in FIG. 2, press together to form the rail. This pressing together of the first and second longitudinal members 16 and 18 is achieved by the provision of a pair of male members 20 formed at edges 24 of the first longitudinal member 16.

A pair of corresponding female members 26 are formed at edges 28 of the second longitudinal member 18 to receive the male members 20 with a press fit. As is clear in FIGS. 2 to 4 the fence may be produced as an extrusion but the shape shown is, subject to comments made below, immaterial.

As shown most clearly in FIG. 3, there is a plurality of spaced openings 30 formed in the first longitudinal member 16 with an open edge for each opening at an edge 24 of the first longitudinal member 16, that is adjacent the lower male member 20.

The pickets 12 are each formed with a pair of channels 32 on each side, adjacent an end. As shown particularly in FIGS. 2 and 3, there are spaced projections 34 on the first longitudinal member 16 and spaced projections 36 on each second longitudinal member 18 to be received in the channels 32 to locate the picket 12.

FIG. 2 also shows the provision of a raised portion 37 adjacent the outer edge of each female member 26 of the second longitudinal member 18 to prevent egress of the triangular ends of the male members 20. Serrations 38 shown in FIG. 3 also facilitate contact with a settable composition received in the female members.

Thus to construct the structure shown in FIG. 1, the longitudinal members 16 and 18 are cut to length to extend between end posts, not shown. Pickets 12 are located in a first longitudinal member 16 with the projections 34 of the first longitudinal member engaging one pair of channels 32 in the picket 12. An appropriate settable compound, silicone, an epoxy adhesive or the like, is placed in the female members 26 and the first and second longitudinal members 16 and 18 are then pressed together with the projections 36 on the second longitudinal member 18 engaging the other pair of channels 32, that is opposed to those already engaged on the projections 34 of the first longitudinal member 16. Pressing together of the first and second longitudinal members 16 and 18 ensures engagement of the male and female members 20 and 26 and of the pickets on the projections. In this way an extremely secure and stable structure is provided, assisted by the settable compound in female members 26.

Further stability may be achieved, in extreme cases, by inserting self-tapping screws through the outer wall of member 16 and through the upstanding wall of member 16 carrying projection 34. The screw is self-tapped into a hole formed in longitudinal member 18 adjacent upper projection 36. The screw is counter-sunk and may be placed at, for example, three foot intervals. It will be unobtrusive.

If required the bottom rail may be attached in precisely the same way and, in constructing the structure, the lower first longitudinal members will be engaged in the same way and at the same time as the upper first longitudinal members. The two second longitudinal members are then engaged to complete the structure.

The present invention thus provides a structure of great simplicity yet rigidity. The pickets are secured firmly and without rattling.

I claim:

1. A rail structure having a rail attached to a plurality of pickets, the rail comprising first and second longitudinal members that are pressed together to form the rail;

a plurality of spaced openings formed in the first longitudinal member with an open edge for each opening at an edge of the first longitudinal member;

an opposed pair of spaced channels formed in each side of each picket adjacent and end of the picket, a first channel of each pair being closer to the end of the picket than the second channel of each pair;

first projections in the interior of each first and second longitudinal member to fit closely into the opposed first channels on a picket;

second projections on each first and second longitudinal member to fit closely into opposed second channels on a picket;

a pair of male members formed at a pair of side edges of the first longitudinal member;

a pair of female members formed at a pair of side edges of the second longitudinal member to receive the male members of the first longitudinal member with a press fit to form the rail;

whereby pressing together of the first and second longitudinal members, with pickets located between the first and second longitudinal members in the plurality of spaced openings formed in the first longitudinal member, to engage the male members of the first longitudinal member with a female members of the second longitudinal member engages the first and second projections respectively in the first and second channels with a press fit that prevents movement of the pickets relative to the rail.

2. A structure as claimed in claim 1 including a settable compound in the female members of the second longitudinal member to secure the male members.

3. A structure as claimed in claim 1 in which the male members are of generally triangular section and in which the female members include a raised portion to prevent egress of the male member.

4. A structure as claimed in claim 3 including serrations on the surface of the male members.

5. A structure as claimed in claim 1 made of aluminum.

6. A structure as claimed in claim 1 including top and bottom rails each attached to the plurality of pickets.

* * * * *